United States Patent [19]

Decker

[11] 4,252,452

[45] Feb. 24, 1981

[54] ARABIC LANGUAGE TYPEWRITER

[75] Inventor: Herbert Decker, Lauf, Fed. Rep. of Germany

[73] Assignee: Triumph-Werke Nuremberg A.G., Nuremberg, Fed. Rep. of Germany

[21] Appl. No.: 29,259

[22] Filed: Apr. 11, 1979

[30] Foreign Application Priority Data

Apr. 13, 1978 [DE] Fed. Rep. of Germany ..... 2815972

[51] Int. Cl.[3] ..... B41J 19/30

[52] U.S. Cl. ..... 400/323.1; 400/111; 400/310

[58] Field of Search ..... 400/111, 310, 320, 322, 400/323, 323.1

[56] References Cited

U.S. PATENT DOCUMENTS 2,524,854 10/1950 Salmon ..... 400/323.1

OTHER PUBLICATIONS

"Typewriter with Reversible Writing Line", by L. E. Palmer, IBM Technical Disc. Bulletin, vol. 14, No. 4, Sep. 1971, pp. 1152–1157.

*Primary Examiner*—Paul T. Sewell

*Attorney, Agent, or Firm*—Joseph R. Spalla

[57] ABSTRACT

An Arabic language or other right to left writing typewriter having mechanism normally effecting letter feeding movement from right to left in response to type actions is provided with additional mechanism selectively operatively positionable to effect power operated left to right letter feeding movement in response to type actions.

2 Claims, 2 Drawing Figures

Fig_1
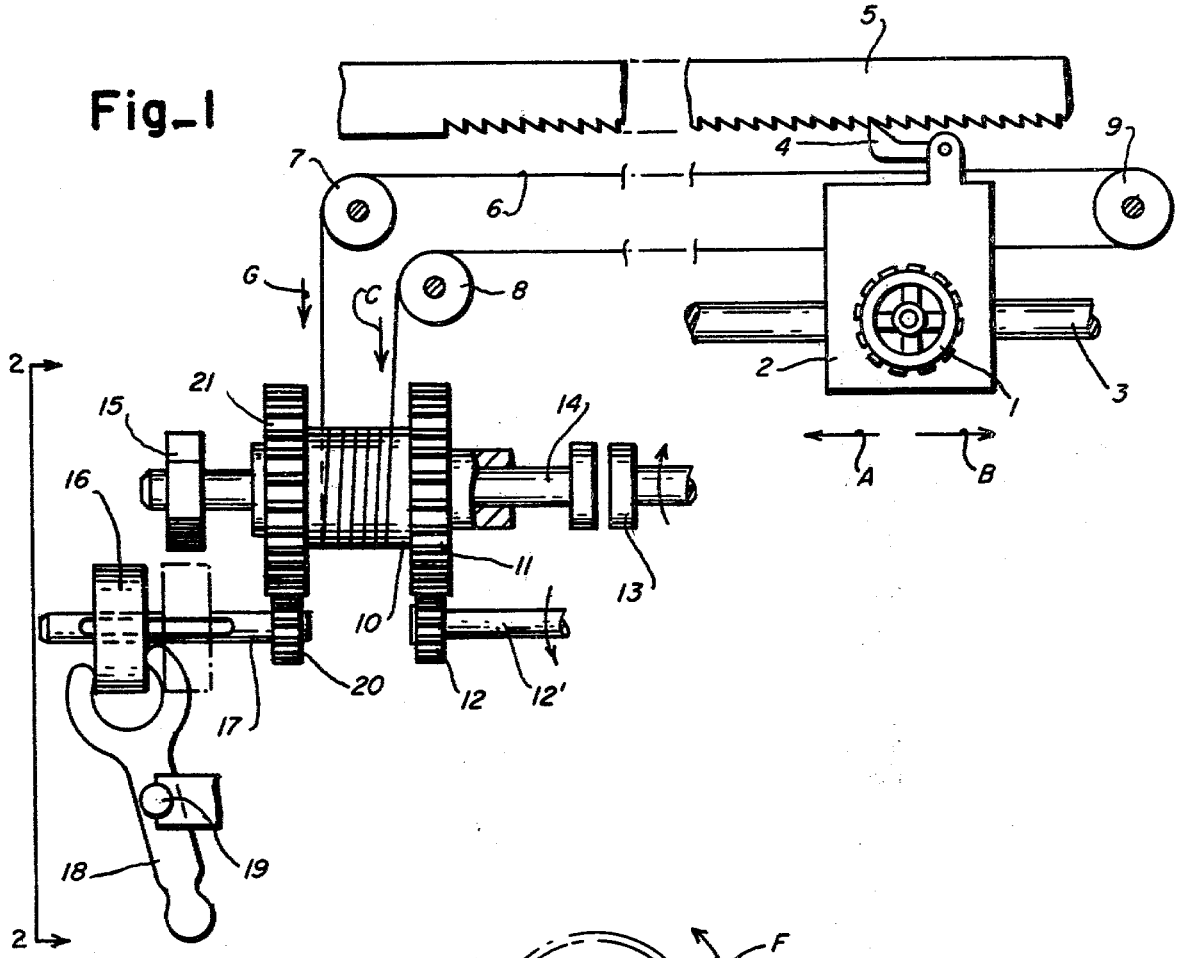
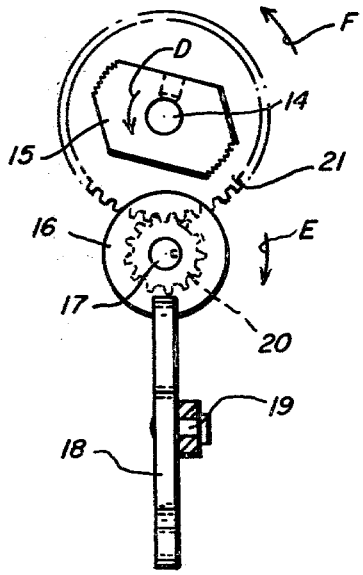
Fig_2

ARABIC LANGUAGE TYPEWRITER

This invention relates to right to left letter feeding typewriters; more particularly, it relates to a right to left letter feeding typewriter having mechanism selectively positionable to effect powered letter feeding movement in left to right direction which overcomes but does not disable the mechanism normally controlling right to left letter feeding movement.

Typewriters having mechanism for changing letter feed direction to permit typing of right to left or left to right reading language are disclosed in Applicant's co-pending U.S. Application Ser. No. 898,957, filed Apr. 21, 1978 now U.S. Pat. No. 4,198,170. As disclosed in said co-pending application, the operational keys, e.g., backspace, carriage return, have their normal significance in either established writing direction.

Typewriters intended for use only in right to left direction are, however, in demand. In such a typewriter designed to write only from right to left, e.g., the Arabic language, one peculiarity presents a problem. The problem arises due to the fact that higher order digits of multidigit numbers are read and written from left to right. Thus, in a right to left writing typewriter, an operator is required, contrary to habit, to type the lowest order digit of a multidigit number first and follow with ascending orders. Alternatively, in a right to left writing typewriter, he can count the number of digits in a multidigit number, and move the carriage an equal number of spaces to the left and they type beginning with the highest order digit of the number. This, however, requires two backspace operations after each digit typed to position the carriage to receive the digit in the next lowest order. It is even more tedious where columns of multidigit numbers are to be typed.

In accordance with the invention, there is provided mechanism which can be simply and econimically incorporated, without undue and costly redesign, into a right to left writing typewriter as will allow an operator to selectively change the writing direction within a line of right to left typed next to facilitate typing multidigit numbers from left to right or to facilitate typing columns of numbers. Carriage moving functions, except for space, following the changeover to left to right writing continue to function in the Arabic sense.

An object of the invention is in the provision of a right to left writing typewriter which can be switched over to permit typing in a left to right direction to facilitate typing multidigit numbers in an Arabic text.

Another object of the invention is in the provision of means for enabling, in an Arabic typewriter, numbers to be written from left to right in a facile manner in an inexpensive manner.

Other objects and many of the attendant advantages of this invention will be readily appreciated as the same becomes better understood by reference to the following detailled description when considered in connection with the accompanying drawing in which like reference numerals designate like parts throughout the Figures thereof and wherein:

FIG. 1 is a top plan view of the invention embodied in a right to left writing typewriter; and FIG. 2 is a view taken along lines 2—2 of FIG. 1.

Referring now to the drawing, the invention as shown in FIG. 1 is illustrated in connection with a single element type body mounted on a movable carriage. It is to be understood, however, that it applies also to typewriters having a moving paper carriage.

The type body 1 is arranged on a carriage 2 which is guided on a guide bar 3 for letter feeding movement, in an Arabic typewriter, from right to left in direction A and carriage return movement in direction B. A pawl 4, engaging in a rack 5, controls letter feeding in known manner. To this end, a cable system 6 connected to opposite sides of the carriage 2 passes over guide rolls 7, 8, 9 and is wound and unwound on a cable drum 10. The cable drum 10 is equipped in known manner with a spring (not shown) which is tensioned upon carriage return. The stepping or letter feed movement of carriage 2 by one character division, when pawl 4 is momentarily disengaged from the rack 5, takes place under the action of the spring powered cable drum 10 so that the cable traction is in the direction of arrow C. The spring powered cable drum 10 also has a gear 11 in engagement with a pinion 12. This pinion is driven by the output shaft 12' of a clutch, not shown, for the purpose of carriage return, so that the carriage 3 is pulled in arrow direction B until it has reached its right end position.

In a normal typing operation from right to left, pawl 4 is briefly withdrawn from the serration of rack 5, so that the spring can drive the cable drum 10 in such a way that carriage 2 moves by one division in arrow direction A.

In accordance with the invention, to make it possible to write from left to right in response to type actions, there is provided a clutch 13 whose output shaft 14 mounts a cam 15. Adjacent to the cam 15 is a friction wheel 16, which is supported non-rotationally, but longitudinally displaceable, on a shaft 17. The longitudinal displacement of friction wheel 16, which is effected by means of an operator controlled switch lever 18, is pivotably mounted in the machine frame at 19. FIG. 1 shows its non-operative position in solid lines and the operative position in dash-dot lines. Shaft 17 carries on its end a pinion 20 in engagement with a second gear 21 secured on the cable drum 10.

Incident to every typing operation, the half-revolution clutch 13 is briefly closed, so that shaft 14 and hence cam 15 rotate in arrow direction D. As they do so, cam 15 executes half a revolution. When friction wheel 16 is in the non-operative position, pinion 20 idles along with the rotary movement of gear 21 and drum 10. When, however, the friction wheel 16 is brought into the operative position, it is driven by cam 15. Pinion 20 then rotates in arrow direction E, whereby gear 21 of drum 10 is rotated in arrow direction F. Owing to this, because it winds onto drum 10, cable 6 pulls in arrow direction G, causing the type body carriage 2 to move in arrow direction B. The movements of clutch 13, cam 15 and gear train 16, 20 and 21 are matched so that the type body carriage 3 is then moved only by one division in arrow direction B, overcoming the urge of the carriage in direction A incident to release of the pawl from the rack in response to the type action, and pawl 4 merely clinks over one tooth of rack 5 if it reengages before the carriage completes a movement in arrow direction B.

If, therefore, the operator of a typewriter equipped according to the invention wants to write numbers, he brings the friction wheel into operative position, or numeric typing mode, by means of switch lever 18. Upon actuation of a type key, cam 15 is driven by means of clutch 13 for half a revolution. Drum 10 winds cable 6 in arrow direction G, so that the type body carriage 2 executes a step from left to right. For normal writing of text, the additional drive can be switched off and the writing operation is carried out from right to left. The operational keys are not influenced by the additional gear train, so that their functions are not switchable as to direction. However, if the machine is further designed to operate clutch 13 in response to a space bar operation, operation of the space bar will also result in left to right carriage movement in numeric mode. Alternatively, to space left to right in numeric mode, the backspace key, which normally moves the carriage in Arabic typing left to right, can be used.

The invention claimed is:

1. In an Arabic language or other right to left writing typewriter having a frame, a carriage movable relative to said frame, spring means conncted to urge said carriage to move in a right to left direction, escapement means normally controlling the movement of said carriage by said spring means step by step in right to left direction in response to each type action, means power operated in response to each type action, normally disengaged means positionable for driving engagement with said power operated means and connected to incrementally move said carriage step by step in a left to right writing direction, and operator controlled means for positioning said normally disengaged means into or out of driving engagement with said power operated means whenever a change in writing direction is desired, said power operated means including a power shaft cyclically driven in response to each type action, a cam on said power shaft, said normally disengaged means including an output shaft, means connecting said output shaft to drive said carriage, and an axially positionable friction roll mounted on said output shaft for driving said output shaft when positioned for driving engagement by said cam.

2. A typewriter as recited in claim 1, said spring means including a cable drum, a cable wound about said drum having its ends connected to said carriage, and a gear on said cable drum, said means connecting said output shaft to drive said carriage comprising an output gear on said output shaft engaged with said cable drum mounted gear.

* * * * *